US005360276A

United States Patent [19]

Petermann

[11] Patent Number: 5,360,276

[45] Date of Patent: Nov. 1, 1994

[54] PRINTING DEVICE WITH ADJUSTABLE PRINTING HEAD GAP

[75] Inventor: Udo Petermann, Altenbeken, Germany

[73] Assignee: Siemens Nixdorf Informationssysteme Aktiengesellschaft, Munich, Germany

[21] Appl. No.: 971,982

[22] PCT Filed: Aug. 6, 1991

[86] PCT No.: PCT/EP91/01484

§ 371 Date: Feb. 10, 1993

§ 102(e) Date: Feb. 10, 1993

[87] PCT Pub. No.: WO92/02370

PCT Pub. Date: Feb. 20, 1992

[30] Foreign Application Priority Data

Aug. 10, 1990 [DE] Germany ..... 4025483

[51] Int. Cl.[5] ..... B41J 25/308

[52] U.S. Cl. ..... 400/55; 400/56; 400/57; 400/59

[58] Field of Search ..... 400/55, 56, 57, 58, 400/59

[56] References Cited

U.S. PATENT DOCUMENTS

| | | | |
|---|---|---|---|
| 4,676,675 | 6/1987 | Suzuki et al. | 400/56 |
| 4,943,174 | 7/1990 | Eicher | 400/703 |
| 4,974,974 | 12/1990 | Yoshida et al. | 400/56 |
| 5,087,135 | 2/1992 | Tew et al. | 400/55 |
| 5,193,918 | 3/1993 | Lohrmann et al. | 400/57 |

FOREIGN PATENT DOCUMENTS

| | | |
|---|---|---|
| 0292102A1 | 11/1988 | European Pat. Off. . |
| 0341787A3 | 11/1989 | European Pat. Off. . |
| 0361676A1 | 4/1990 | European Pat. Off. . |
| 2608301C2 | 9/1977 | Germany . |
| 3830880A1 | 3/1990 | Germany . |
| 62-212180 | 9/1987 | Japan . |
| 62232428 | 3/1989 | Japan . |
| 1519274 | 7/1978 | United Kingdom . |

OTHER PUBLICATIONS

"Dynamic Head To Platen Gap Measuring Tool" by Gianmoena et al, IBM Technical Disclosure Bulletin vol. 25, No. 10, Mar. 1983, p. 5176.

*Primary Examiner*—David A. Wiecking
*Attorney, Agent, or Firm*—Hill, Steadman & Simpson

[57] ABSTRACT

In a printing device having an abutment (10) intended for supporting a recording medium (52), a print head (32) which is movable relative to the abutment (10) in the direction of the lines, an actuating drive (28, 26, 24) for setting the print head distance relative to the abutment (10) and a pressing element (36) which extends the full width of the recording medium and presses the recording medium (52) onto the abutment (10) and can be deflected in accordance with the thickness of the recording medium (52), a magnet (54) is arranged on one of the parts (pressing element 36, part 46 fixed to the print head) and at least one Hall probe (56) is arranged on the respective other part (part 46 fixed to the print head, pressing element 36) in such a way that the magnet (54) and the Hall probe (56) can be brought into congruence with one another in a predetermined print head position corresponding to a measurement position, a circuit arrangement (60) being provided to measure the Hall voltage and to regulate the latter to a predetermined value (intended Hall voltage), which circuit arrangement controls the actuating drive (28, 26, 24) of the print head (32) as a function of a difference between the actual Hall voltage and the intended Hall voltage.

11 Claims, 3 Drawing Sheets

PRINTING DEVICE WITH ADJUSTABLE PRINTING HEAD GAP

BACKGROUND OF THE INVENTION

1. Field of the Invention

The invention relates to a printing device and, in particular, a printer having a frame, an abutment retained therein for supporting a recording medium, a print head which is mounted on the frame so aa to be movable relative to the abutment in the direction of the print lines, an actuating drive for setting the print head distance relative to the abutment, and a pressing element which is fixed to the frame, presses the recording medium onto the abutment and can be deflected substantially perpendicular to the surface of the abutment in accordance with the thickness of the recording medium.

2. Description of the Related Art

U.S. Pat. No. 4,676,675 discloses an apparatus for adjusting the portion of a print head in a matrix printer in which a sensor intended for resting on the surface of the recording medium is arranged on the print head carrier. The print head carrier can be adjusted with the aid of an eccentric adjusting mechanism toward and away from the abutment. To determine the thickness of the recording medium, the latter is first drawn into the printing position. The print head carrier is then moved into a reference position which is located furthest away from the abutment and is determined by means of a light barrier. The distance of the sensor surface from the abutment in this reference position is stipulated and known. The print head carrier is subsequently moved toward the abutment until the sensor rests with a particular contact pressure on the surface of the recording medium which has in the meantime been drawn in, the path covered up to this point being measured by means of a counter. Subsequently, this measured route is subtracted from the previously known reference route in the arithmetic unit. The difference corresponds to the thickness of the recording medium. On the basis of the value thus determined for the thickness of the recording medium, the print head carrier is then moved away from the abutment again until the desired distance between the print head and the surface of the recording medium has been set.

The method described above is relatively cumbersome and complex. A further disadvantage in this solution is that the calculation of the thickness and thus also the setting of the head distance can only take place when the recording medium is already in the printing position. This leads to a considerable loss of time. Furthermore, the distance between the abutment and the sensor must not be greater than the distance between the abutment and the print head. On the other hand, however, it must not be substantially smaller either since it would otherwise not be possible to set the distance between the surface of the recording medium and the print head to a desired value. This requires not only a relatively precise adjustment of the sensor relative to the print head, but can also cause difficulties when paper of a different thickness is drawn in.

In order to eliminate the disadvantages described above, it has already been proposed in an apparatus of the type known from U.S. Pat. No. 4,676,675 to arrange a sensor ahead of the printing position—seen in the drawing—in direction of the recording medium—on a part which is fixed to the printer frame relative to the abutment in such a way that, when the recording medium has not yet been drawn in, it rests on the abutment and can be deflected or deformed by the recording medium being drawn in, the deflection or deformation of the sensor being converted into a proportional electrical parameter. The sensor proposed in this solution comprises movable parts which become soiled due to the unavoidably occurring paper dust and can thus become jammed. Furthermore, these mechanical parts would have to be adjusted.

The document German Published Application 26 08 301 C 2 furthermore discloses an apparatus for controlling the distance of a print head from a recording medium, in which a sensor in the form of a two-armed lever is mounted so as to be pivotable on the print head carrier or the print head carriage in such a way that it can rest with the one free end of the lever on the recording medium in the region of the respective printing point. The sensor is formed from a thin metal sheet which is pressed by a spring with a very small contact pressure against the recording medium such that the sensor can slide over the paper virtually without resistance. At its contact point, the metal sheet has a cutout, through which the needles of the print head can pass. At its lever end facing away from the contact point, this sensor bears a magnet which interacts with a Hall probe arranged on the print head carrier. The print head carrier or the print head slide is moved perpendicular to the abutment via an electronic control circuit until a reference voltage, corresponding to a predetermined distance of the print head from the recording medium, occurs on the Hall probe. This solution has considerable disadvantages in practical operation. On the one hand, the sensor must rest only very lightly on the surface of the recording medium as it could otherwise impede the movement of the print head and damage the recording medium during the movement of the print head. On the other hand, however, it is precisely this small contact pressure which leads to the sensor reacting to any unevenness in a recording medium. This is particularly noticeable in multi-layered recording media, for example sets of forms or savings books. However, momentary deflections of the sensor lead to a permanent readjustment of the print head, as a result of which the printing performance of the printing device is considerably impaired. Additionally, the setting of the correct distance can only take place when the recording medium has already reached the nozzle of the print head, i.e. is in its recording position. Since the sensor is situated in the direct vicinity of the print head nozzle, past which the ink ribbon also runs, there is the risk that the sensor will be damaged when the ink ribbon is changed. This risk is all the greater as the sensor has to be very thin and of light-weight construction for reasons of space and function. Furthermore, since the sensor is pressed onto the recording medium by a spring and the pressing force is to be only very small, a slight change in the pressing force already leads to the sensor being more or less pressed into the recording medium, which occurs particular with multi-layered recording media. Consequently, it is necessary for the pressing spring to be adjusted very precisely. In practical experience, this is extremely difficult. In the case of weak springs, in particular, a slight bending of the spring is generally enough to change its pressing force considerably. It is therefore exceptionally difficult to adjust a sensor of this type and to maintain the adjustment during operation.

SUMMARY OF THE INVENTION

The underlying object of the invention is to improve a printing device having a frame, an abutment retained therein for supporting a recording medium, a print head which is mounted on the frame so as to be movable relative to the abutment in the direction of the lines, an actuating drive for setting the print head distance relative to the abutment, and a pressing element which is fixed to the frame, presses the recording medium onto the abutment and can be deflected substantially perpendicular to the surface of the abutment in accordance with the thickness of the recording medium so that movable parts of the sensor requiring mechanical adjustment can be omitted and that the apparatus is simple in construction and sturdy in operation.

According to the invention, this object is achieved by a magnet arranged on one of the parts (either the pressing element or the part fixed to the print head) and at least one Hall probe arranged on the respective other part (either the part fixed to the print head or the pressing element) in such a way that the magnet and the Hall probe can be brought into congruence with one another in a predetermined print head position corresponding to a measurement position, and a circuit arrangement is provided to measure the Hall voltage and to regulate the latter to a predetermined value (an intended Hall voltage), which circuit arrangement controls the actuating drive of the print head as a function of a difference between the actual Hall voltage and the intended Hall voltage.

The solution according to the invention has the advantage that the sensor operates in a contactless manner and requires no mechanical parts which would have to be adjusted and whose function could be deteriorated by paper dust that arises.

Both parts of the Hall sensor are arranged on parts of the printing device which are present in any case, namely on the one hand on the pressing element, and, on the other hand, on the print head or print head carriage. The pressing element is clamped so firmly against the abutment that it presses the recording media to be processed flatly onto the abutment. The measurement is thus not falsified by bulges, creases or folds in the recording medium since the latter is pressed flat in any case. Since the spring which pre-stresses the pressing element toward the abutment has to be relatively strong, slight deviations from the usual spring force are unimportant. Any adjustment is therefore relatively non-critical. The mounting of the one part of the Hall sensor on the pressing element ensures that the setting of the print head distance can already take place while the recording medium is still being drawn into its printing position. When it has reached this position, the print head is also set to the correct distance. A delay in setting the print head distance is thus avoided.

The abutment can be a platen in a known manner per se, the pressing element preferably being an elastically deformable metal pressure plate extending over the entire width of the abutment.

A second Hall probe thermally coupled to the first Hall probe is preferably provided on the pressing element outside the region over which the print head brushes during its movement along the abutment. The good thermal coupling between the two Hall probes allows the output signal of the second probe to be used to compensate the temperature response of the first probe.

The invention furthermore relates to a method of setting and maintaining a predetermined distance of a print head of a printing device from a recording medium including, prior to the recording medium being drawn into the printing device, the print head being moved parallel to the abutment into a measuring position in which a sensor element (either the magnet or the Hall probe) on the pressing element is brought into congruence with the sensor element fixed to the print head for the distance measurement, the print head being adjusted perpendicular to the abutment until an actual Hall voltage generated at the distance sensor is equal to a predetermined intended Hall voltage, the print head being moved over a predetermined path section out of this alignment position away from the abutment, the recording medium being drawn in, and the print head being moved toward the abutment until the actual Hall voltage once more corresponds to the intended Hall voltage, the path section thereby covered by the print head being registered.

The method is further characterized by the thickness of the recording medium being determined from the difference between the predetermined path section covered by the print head and the path section covered by the print head until the alignment position is reached with the recording medium having been drawn in and the intended Hall voltage is set as a function of the thickness of the recording medium.

Advantageous embodiments of the invention include the abutment being a platen and the pressing element being an elastically deformable metal pressure plate extending over the entire axial length of the platen. The print head is attached to a carrier which is adjustable parallel to the abutment, and the part fixed to the print head is a guide element for the recording medium, the guide element being firmly connected to the print head carrier. An added improvement is that the print head carrier is mounted on an eccentrically mounted shaft which is rotatable by means of an actuating drive.

A further feature provides a second Hall probe, which is thermally coupled to the first Hall probe, on the pressing element outside the region over which the print head brushes during its movement along the abutment. The distance of the print head from the recording medium can be set as a function of the thickness of the latter.

A preferred embodiment has a memory for storing a plurality of intended Hall voltage values corresponding to different thicknesses of the recording medium in the circuit arrangement.

The print head is a needle print head. Alternately, the print head is a thermal print head. The print head may even be an ink jet print head.

BRIEF DESCRIPTION OF THE DRAWINGS

Further features and advantages of the invention emerge from the following description which explains the invention with reference to an exemplary embodiment and in conjunction with the attached drawings, in which.

DETAILED DESCRIPTION OF THE PREFERRED EMBODIMENTS

Figure 1:
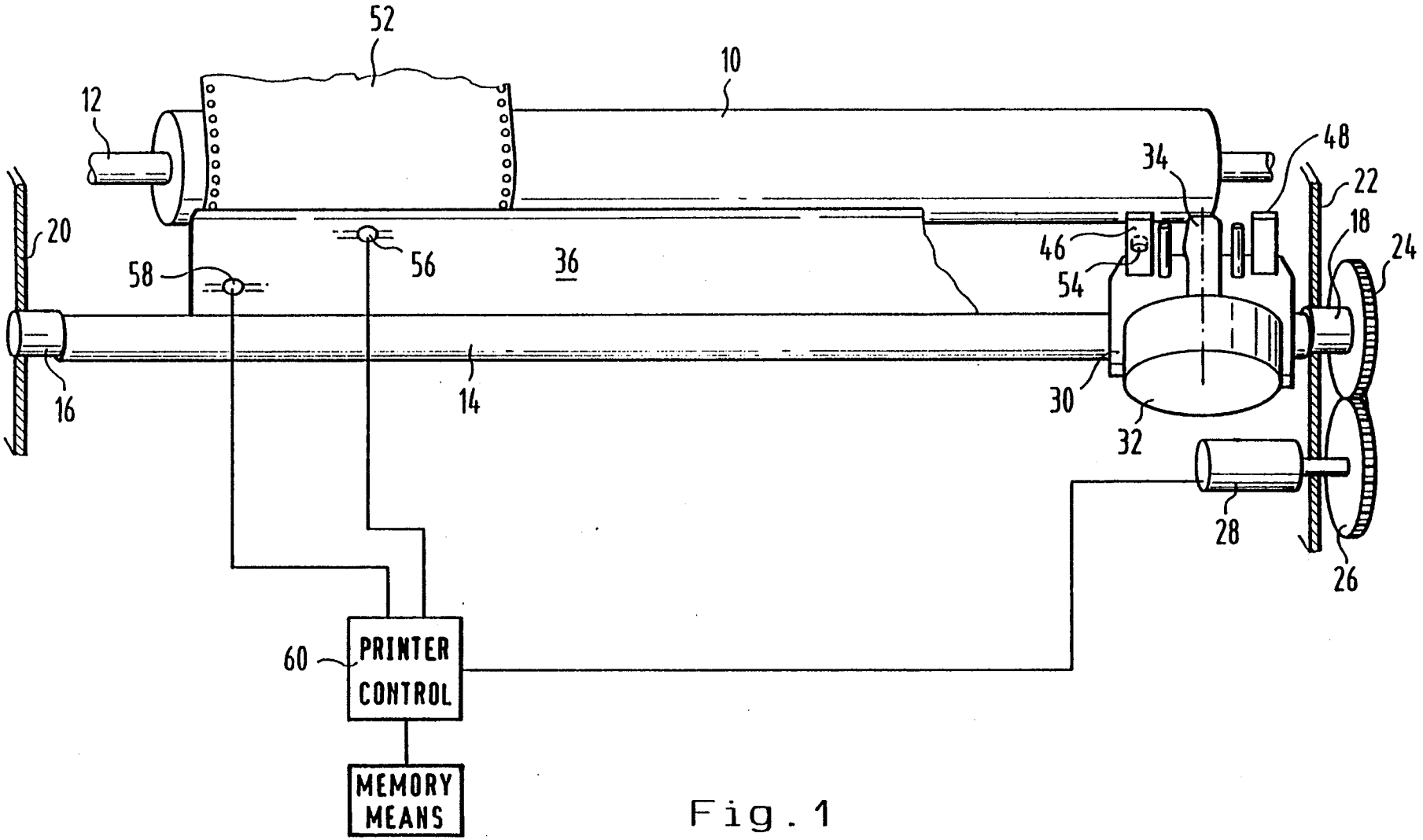
FIG. 1 shows a diagrammatic front view of the parts of a needle printer which are essential to explain the invention.
Figure 2:
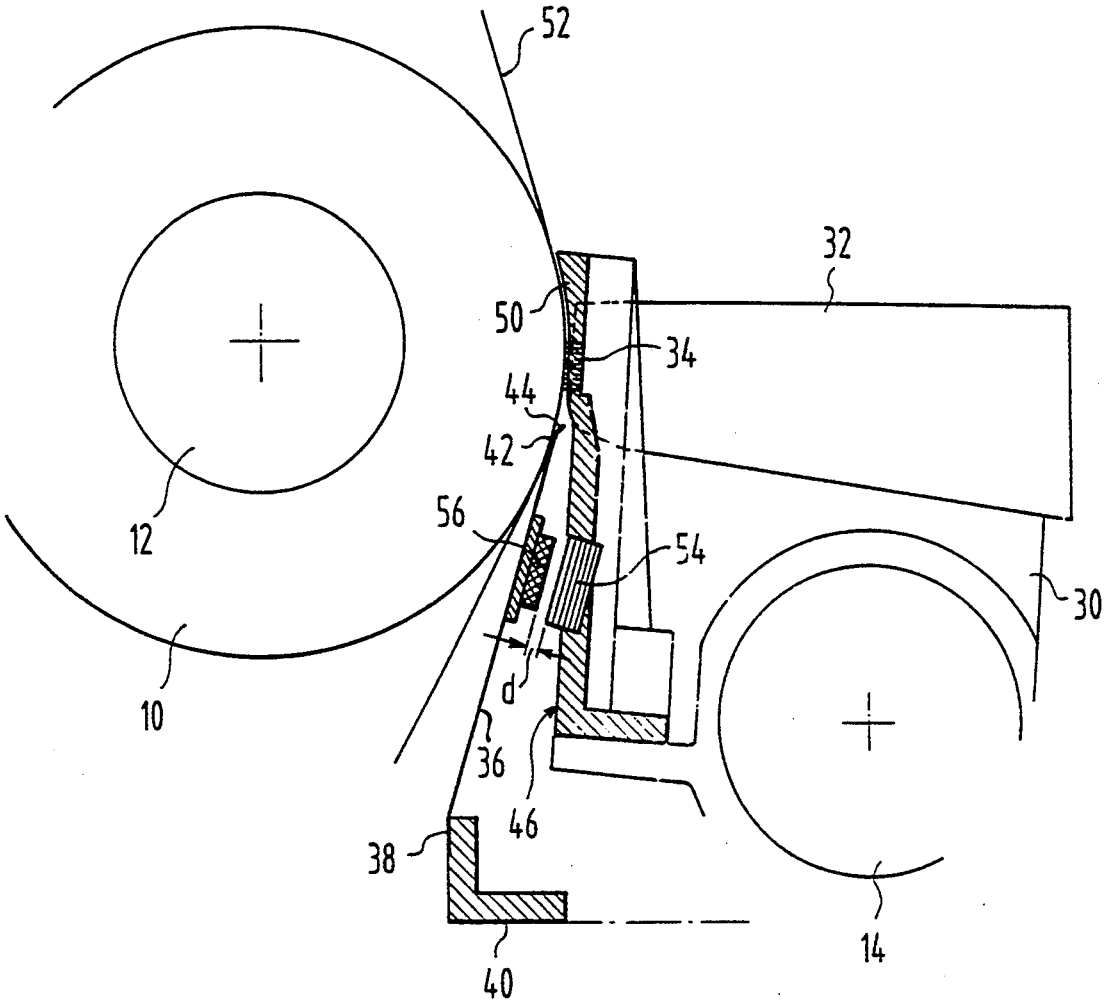
FIG. 2 shows a diagrammatic sectional view perpendicular to the platen axis through the arrangement according to FIG. 1.

An abutment serving as a platen denoted by 10 can be seen in FIGS. 1 and 2. Arranged ahead of and in parallel to the shaft 12 of the platen 10 is a print head guide 14 which is mounted with eccentric bearings 16, 18 in side panels 20, 22 of a printer frame. A pinion 24 is arranged at the end of the print head guide 14 on the right in FIG. 1, which pinion is secure against rotation and meshes with a second pinion 26 seated on the output shaft of a stepping motor 28. Mounted so as to be axially displaceable on the print head guide 14 is a support 30 which, in turn, bears a needle print head 32.

An elastically deformable metal pressure plate 36 is situated below the nozzle 34 of the needle print head 32. Said sheet extends over the entire writing width of the printer. It is firmly connected at its lower edge 38 to a cross bar 40, extending between the side panels 20, 22, of the printer frame and, near to its upper edge, contacts the platen 10 tangentially in a contact line 42 (FIG. 2) directly below the print head nozzle 34. The upper edge 44 of the metal pressure plate 36 is bent over so as to point obliquely away from the platen 10 above the contact line 42.

Arranged on the support 30 on both sides of the print head nozzle 34 are paper guides 46, 48 whose respective upper end 50, located with slight spacing opposite the platen 10, is matched to the contour of the platen 10 (FIG. 2). It is ensured by the arrangement of the metal pressure plate 36 and the paper guides 46, 48, as described above, that a recording medium 52 fits snugly onto the platen 10 in the printing region.

A permanent magnet 54 is inserted in the left-hand paper guide 46. A first Hall probe 56 is bonded to the metal pressure plate 36. As can be seen in FIG. 2, this Hall probe 56 is situated at the height of the permanent magnet 54, such that these elements are located opposite one another when the print head 32 is situated in a corresponding printing position along the platen 10. A second Hall probe 58 is situated on the metal pressure plate 36 outside the region over which the permanent magnet 54 brushes due to the movement of the support 30 along the print head guide 14. Both Hall probes 56, 58 are coupled in a thermally satisfactory manner via the metal pressure plate 36, such that the output signal of the second probe 58 can be used to compensate the temperature response of the first probe 56.

Figure 3:
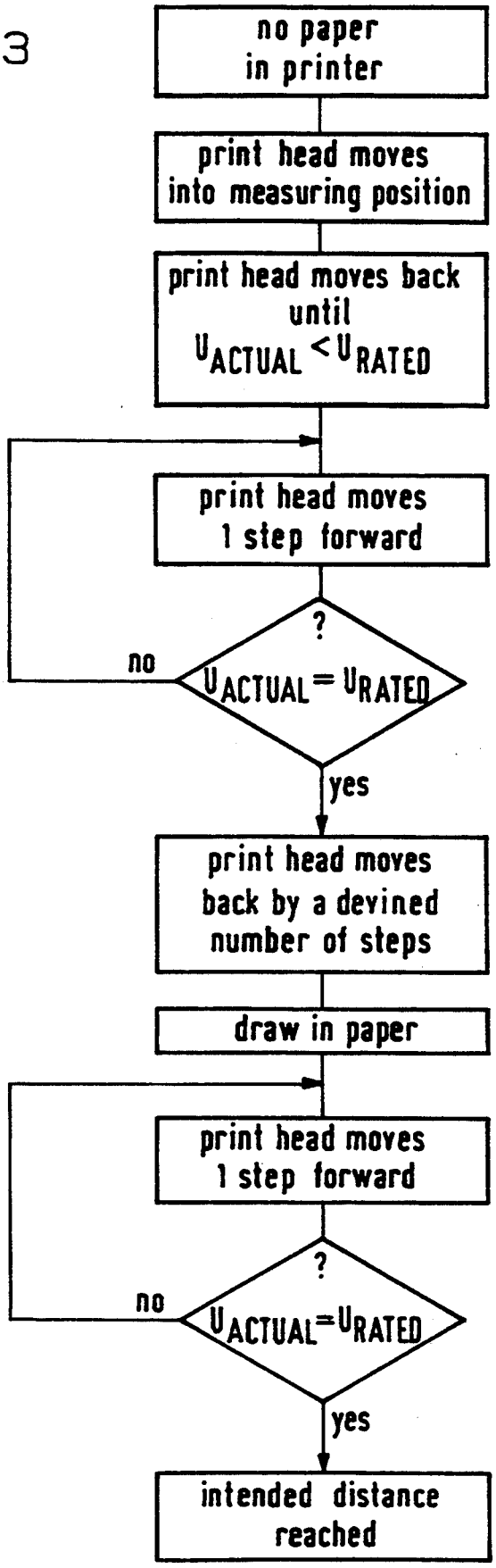
FIG. 3 shows a flow diagram to explain the mode of operation of the printing device according to the invention.

The arrangement described hitherto operates to set the distance of the print head 32 from the surface of the recording medium 52 as follows, reference also being made to the flow diagram in FIG. 3.

During automatic setting, the print head 32 must be in the position in which the permanent magnet 54 and the first Hall probe 56 are located opposite one another. The Hall voltage is dependent on the magnetic induction and thus on the distance d (FIG. 2) between the permanent magnet 54 and the Hall probe 56. This distance d is proportional to the distance of the print head nozzle 34 from the platen 10 or of the surface of the recording medium 52 guided around the cylinder.

The intended head distance is a constant which is specific to the print head used and, depending on the type of head, lies between 0 mm in the case of a thermal print head and 0.5 mm for a needle print head. Corresponding to this distance is a particular Hall voltage value which is permanently stored in the control program for the printer control 60 (FIG. 1).

A recording medium 52 is first drawn into the printer from the underside of the cylinder. During this process, it is inserted between the platen 10 and the metal pressure plate 36. As a result, the distance d is reduced and the Hall voltage increases. The eccentrically mounted print head guide 14 is then rotated via the stepping motor 28 and the pinions 24, 26, as a result of which the distance d changes until the Hall voltage of the Hall probe 56 corresponds to the stored reference value. Consequently, the intended head distance is then set once more. In order to compensate the unavoidable mechanical play, the head positioning is always carried out from the same direction as is shown by the first three steps in the flow diagram of FIG. 3.

In needle printers, a reduction in the intended head distance is sometimes required for thicker types of paper. This can easily be undertaken in the solution according to the invention since the number of motor steps during the setting operation is proportional to the thickness of the paper. Consequently, the actual thickness of the paper can be determined, such that a head distance can be set as a function of the thickness of the paper.

The solution according to the invention was explained with reference to an exemplary embodiment with a needle printer. However, the invention is not restricted to such a needle printer. On the contrary, it can be used with all types of printers in which the distance between the print head and the abutment has to be set as a function of the thickness of the paper.

Although other modifications and changes may be suggested by those skilled in the art, it is the intention of the inventor to embody within the patent warranted hereon all changes and modifications as reasonably and properly come within the scope of his contribution to the art.

I claim:

1. A printing device, comprising:

a frame, an abutment mounted in said frame for supporting a recording medium to be printed on along print lines, a print head is mounted on said frame so as to be movable relative to said abutment in a direction of the print lines, an actuating drive connected to move said print head to various distances relative to said abutment, a pressing element fixed to said frame, said pressing element pressing the recording medium onto said abutment and being deflected substantially perpendicular to a surface of said abutment in accordance with a thickness of the recording medium, said pressing element extending substantially a full length of the print lines, a magnet mounted on one of said pressing element and said print head, at least one Hall probe mounted on a respective other of said print head and said pressing element in such a way that said magnet and said Hall probe can be brought into congruence with one another along the print line corresponding to a measurement position with said print head in a predetermined position laterally remote from said measurement position, and a circuit arrangement connected to said at least one Hall probe to measure a Hall voltage dependent on the deflection of said pressing element along a full print line by said recording medium and to regulate the Hall voltage to a predetermined value, said circuit arrangement being connected to control said actuating drive of said print head as a function of a difference between a measured Hall voltage and a predetermined Hall voltage so that a maximum distance of said print head from the recording medium is set and maintained for said full print line.

2. A printing device as claimed in claim 1, wherein said abutment comprises a platen and said pressing element comprises a metal pressure plate extending over an entire axial length of said platen to determine a paper thickness laterally outside of a paper position.

3. A printing device as claimed in claim 1, further comprising:

a carrier which is adjustable parallel to said the abutment and to which said print head is attached, and a part fixed to said print head as a guide element for guiding said recording medium, said guide element being firmly connected to said print head carrier.

4. A printing device as claimed in claim 3, further comprising:

an eccentrically mounted shaft which is rotatable by said actuating drive and on which said carrier is mounted.

5. A printing device as claimed in claim 1, further comprising:

a memory means connected to said circuit arrangement for storing a plurality of intended Hall voltage values corresponding to different thicknesses of the recording medium.

6. A printing device as claimed in claim 1, wherein said print head is a needle print head.

7. A printing device as claimed in claim 1, wherein said print head is a thermal print head.

8. A printing device as claimed in claim 1, wherein said print head is an ink jet print head.

9. A method of setting and maintaining a predetermined distance of a print head of a printing device from a recording medium, the printing device including a frame, an abutment retained thereon, an actuating drive for adjusting the print head substantially perpendicular to the abutment, a pressing element for pressing the recording medium onto the abutment, and a distance sensor for registering the distance of the print head from the abutment or the recording medium, comprising the steps of:

prior to the recording medium being drawn into the printing device, moving the print head parallel to the abutment into a measuring position in which a sensor element on the pressing element is brought into congruence with a sensor element fixed to the print head for the distance measurement, adjusting the print head perpendicular to the abutment until an actual voltage generated at the distance sensor is equal to a predetermined intended voltage, moving the print head over a predetermined path section out of this alignment position away from the abutment, drawing the recording medium into a printing position in said printing device, and moving the print head toward the abutment until an actual voltage once more corresponds to the intended voltage, a distance thereby traveled by the print head being registered.

10. A method as claimed in claim 9, further comprising the steps of:

determining a thickness of the recording medium from a difference between the predetermined path section covered by the print head and the path section covered by the print head until the alignment position is reached with the recording medium having been drawn in, and setting the intended voltage as a function of the thickness of the recording medium.

11. A printing device, comprising:

a frame, an abutment mounted in said frame for supporting a recording medium to be printed on along print lines, a print head is mounted on said frame so as to be movable relative to said abutment in a direction of the print lines, an actuating drive connected to move said print head to various distances relative to said abutment, a pressing element fixed to said frame, said pressing element pressing the recording medium onto said abutment and being deflected substantially perpendicular to a surface of said abutment in accordance with a thickness of the recording medium, a magnet mounted on one of said pressing element and said print head, at least one Hall probe mounted on a respective other of said print head and said pressing element in such a way that said magnet and said Hall probe can be brought into congruence with one another in a predetermined print head position corresponding to a measurement position, said at least one Hall probe comprising first and second Hall probes that are thermally coupled to one another, said second Hall probe being provided on said pressing element outside a region over which said print head brushes during its movement along said abutment; and a circuit arrangement connected to said at least one Hall probe to measure a Hall voltage and to regulate the Hall voltage to a predetermined value, said circuit arrangement being connected to control said actuating drive of said print head as a function of a difference between an actual Hall voltage and an intended Hall voltage so that a distance of said print head from the recording medium is set independent of a thickness of the recording medium.

* * * * *